US005082129A

United States Patent [19]

Kramer

[11] Patent Number: 5,082,129

[45] Date of Patent: Jan. 21, 1992

[54] SNAP-LOCK FOR SCREW-CAP CONTAINER

[75] Inventor: Steven G. Kramer, San Francisco, Calif.

[73] Assignee: Medcor, Inc., San Francisco, Calif.

[21] Appl. No.: 628,703

[22] Filed: Dec. 17, 1990

[51] Int. Cl.[5] ..... B65D 55/02

[52] U.S. Cl. ..... 215/221; 215/216; 215/230; 215/305

[58] Field of Search ..... 215/221, 203, 204, 216, 215/230, 305

[56] References Cited

U.S. PATENT DOCUMENTS

| | | | |
|---|---|---|---|
| 2,019,106 | 10/1935 | Vos | 215/305 X |
| 2,767,680 | 10/1956 | Lermer | 215/230 X |
| 2,908,413 | 10/1959 | O'Donnell | 215/221 |
| 3,019,931 | 2/1962 | Thornton | 215/221 |
| 3,743,127 | 7/1973 | Morceau | 215/221 |
| 3,841,514 | 10/1974 | Montgomery et al. | 215/216 |
| 3,954,200 | 5/1976 | Willis | 215/221 X |
| 4,011,829 | 3/1977 | Wachsmann et al. | 215/216 X |
| 4,365,722 | 12/1982 | Kramer | 215/220 |
| 4,429,800 | 2/1984 | Greenspan | 215/216 |
| 4,456,136 | 6/1984 | Palsson | 215/216 |
| 4,519,515 | 5/1985 | Schonberger | 215/230 |
| 4,540,098 | 9/1985 | Luker | 215/216 |
| 4,687,112 | 8/1987 | Swartzbaugh | 215/216 |

*Primary Examiner*—Stephen Marcus
*Assistant Examiner*—Vanessa Caretto
*Attorney, Agent, or Firm*—Phillips, Moore, Lempio & Finley

[57] ABSTRACT

A screw-cap type container comprises a container or bottle having a screw thread and an annular flange formed on a neck thereof. The flange is discontinuous to define a locking slot between its opposite ends. A closure cap has an internal screw thread for engaging the screw thread of the container to releasably secure the closure cap thereon. A lock tab, secured to the closure cap, normally engages within the locking slot to prevent relative rotation between the closure cap and container, when they are threadably secured together. When appropriate finger pressure is applied to the lock tab, it will disengage the locking slot for permitting the closure cap to be unscrewed and removed from the container. The closure cap may be of the "reminder" type for visually displaying information to a user relating to periodic use of the contents of the container.

10 Claims, 1 Drawing Sheet

SNAP-LOCK FOR SCREW-CAP CONTAINER

TECHNICAL FIELD

This invention relates generally to containers for medicinal agents and more particularly to the provision of a releasable snap-lock for a screw-cap type container.

BACKGROUND OF THE INVENTION

Screw-cap type containers are widely used for dispensing medicinal drugs in pill, capsule, liquid or gel form. Various regulations require the provision of a tamper-proof or child-resistant locking mechanism for caps of this type. Conventional multi-piece locking mechanisms for the caps are generally unduly complex and difficult to open for some adult users. This difficulty has given rise to recent or proposed regulations requiring that the releasable locking mechanism for a screw-cap be "adult friendly."

In addition to providing a more facile locking mechanism, it has proven further desirable in many medicinal dispensing applications to provide the screw-cap with an adjustable "reminder." The reminder will visually display information (e.g., week, day, time) to a user relating to periodic use of the, contents of the container. For example, U.S. Pat. No. 4,365,722, issued to applicant on Dec. 28, 1982 for "Reminder Closure," discloses unique screw-cap embodiments of the reminder type.

SUMMARY OF THE INVENTION

An object of this invention is to provide an economical and non-complex releasable locking mechanism or snap-lock for a screw-cap type container.

The container comprises an open neck having a screw thread and a circumferential flange formed externally thereon. The flange is discontinuous to define a locking slot therein. A closure cap has an internal screw thread for threadably engaging the screw thread formed on the neck of the container in a conventional manner. A flexible lock tab is secured on the closure cap to normally engage within the locking slot to form a snap-lock when the cap is fully screwed-down onto the container to prevent relative rotation therebetween. Outward flexing of the lock tab to release it from the locking slot will permit the closure cap to be rotated and removed from the container.

In another aspect of this invention, the closure cap has adjustable reminder means thereon for visually displaying information (e.g., week, day, time) to a user relating to periodic use of the container's contents (e.g., pills, capsules, liquid or gel).

BRIEF DESCRIPTION OF THE DRAWINGS

Other objects and advantages of this invention will become apparent from the following description and accompanying drawings wherein.

DESCRIPTION OF THE PREFERRED EMBODIMENTS

Figure 1:
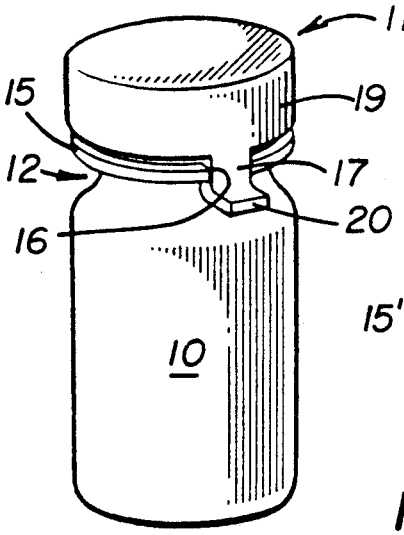
FIG. 1 is a frontal isometric view illustrating a screw-cap type container embodying a snap-lock feature of this invention therein.
Figure 2:
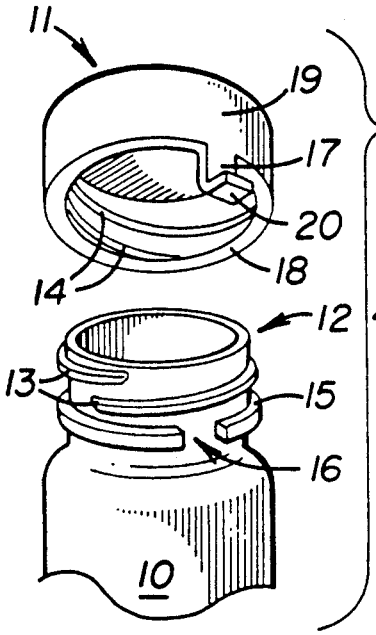
FIG. 2 is an exploded isometric view illustrating removal of a closure cap from the container.

FIG. 1 illustrates a container or bottle 10 having a closure cap 11 threadably secured thereon. As shown in FIG. 2, a neck 12 of the container has a standard spiral screw thread 13 formed externally thereon to threadably engage a similar screw thread 14, formed internally on closure cap 11. Container 10 has a discontinuous flange 15 formed circumferentially about its neck 12, vertically below screw thread 13.

As further shown in FIG. 2, the flange is interrupted circumferentially to define a separation space or locking slot 16 between opposite ends of the flange. Closure cap 11 has a generally vertically disposed lock tab 17 formed integrally thereon and on a frontal side of the closure cap. As shown in FIG. 1, the lock tab is positioned on the closure cap to snap into engagement with locking slot 16 of the container when the screw threads of the closure cap and container are fully engaged, i.e., the closure cap is in its fully tightened condition on the container.

The screw threads, lock tab, locking slot and attendant structures are suitably sized to permit the lock tab to flex outwardly from the container and "ride-over" flange 15 prior to complete tightening of the closure cap onto the container. For example, the outer annular surface of flange 15 is disposed radially outwardly from the outer surface of screw thread 13 and the inner surface of lock tab 17 to facilitate the snap-lock function. The opposed ends of flange 15 could be suitably rounded or chamfered to provide a smooth transition of lock tab 17 into its final engagement within locking slot 16.

As described below, the lock tab is preferably formed from a suitable plastic material, exhibiting the desired flexibility and related physical properties for this purpose. The lock tab is preferably formed (molded) as a one-piece structure with the closure cap. As shown, the lock tab extends downwardly from a lower edge 18 of a cylindrical sidewall 19 of the closure cap and, preferably, has the same radial thickness.

The cantilevered lock tab terminates at its free end at a thumb tab 20, extending outwardly from the lock tab and container. When it is desired to remove the closure cap from the container, thumb tab 20 is engaged by a thumb or finger and lifted to flex lock tab 17 outwardly to disengage it from locking slot 16. The user is thus enabled to rotate closure cap (normally counterclockwise) to remove it from container or bottle 10.

Other shapes and positioning of the snap-lock comprising locking slot 16 and lock tab 17 could, of course, be used. For example, the locking slot and lock tab could have wedge-shaped cross-sections (pointing up or down). Further, two or more circumferentially spaced snap-locks could be utilized.

The separation distance defined between the opposed ends of flange 15 is slightly greater than the circumferential width of lock tab 17 to permit the lock tab to be readily snapped into place within locking slot 16. The container and closure cap can be formed by injection molding, or any other suitable molding process, and are composed of a plastic material exhibiting the desired physical properties, such as flexibility, compressibility, modulus of elasticity, toughness and related physical and chemical characteristics. For example, the plastic material could comprise polypropylene, polyethylene, polyvinlychloride, polyacrylonitrile or the like.

It should be understood that closure cap 11 could be suitably modified to provide a "reminder" feature of the type disclosed in U.S. Pat. Nos. 4,220,247 and 4,365,722. In particular, these patents disclose various embodiments of adjustable reminder means on a closure cap for visually displaying information (e.g., week, day, time) to a user relating to periodic use of contents of the container.

Figure 3:
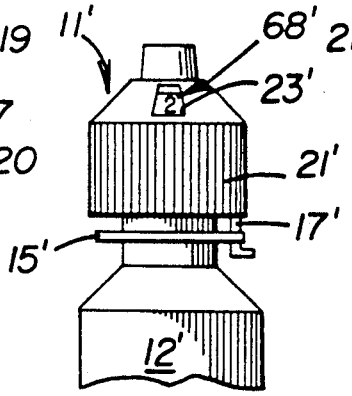
FIG. 3 is a partial frontal elevational view illustrating another container embodiment, further having adjustable reminder means on the closure cap thereof for visually displaying information to a user relating to periodic use of the contents of the container.
Figure 4:
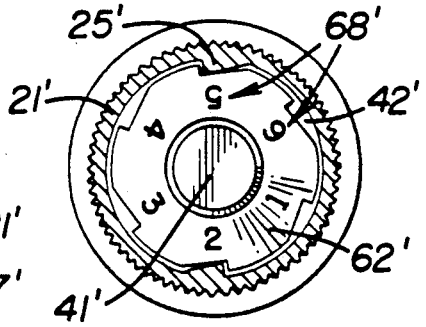
FIG. 4 is a top plan view of the container shown in FIG. 3, but with portions removed to expose a ratchet mechanism therein.
Figure 5:
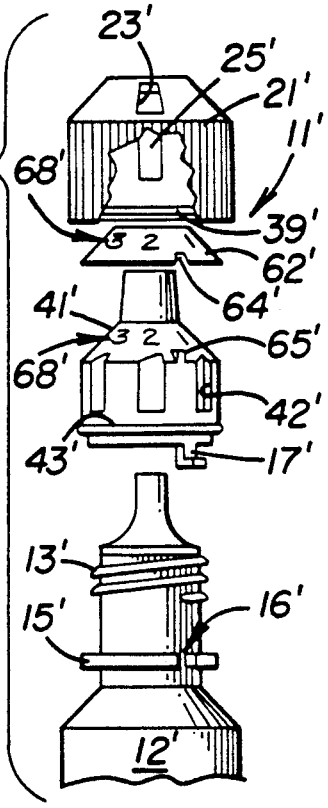
FIG. 5 is an exploded view of the FIG. 3 container.

For example, FIGS. 3-5 illustrate a closure assembly 11' of the reminder type, further incorporating the snap-lock feature of this invention therein. The majority of numerals appearing in FIGS. 3-5 depict components and constructions identical to like-numbered ones disclosed in FIGS. 8-10 of U.S. Pat. No. 4,365,722, but are accompanied by a prime symbol (').This patent, incorporated by reference herein, can be referred to for a detailed explanation of the reminder function, if needed.

As shown in FIGS. 3-5, closure assembly 11' is threadably secured onto the neck of a container or bottle 12'. The drawings illustrate a container that has particular use as an ophthalmic drop dispensing bottle wherein its neck is generally conically shaped to provide a standard open tip portion for dispensing purposes. However, it should be understood that closure assembly 11' and container 12' could be modified to assume other configurations, such as the pill-type configuration shown in FIGS. 1 and hereinafter described FIG. 9.

Referring to FIG. 5, closure assembly 11' includes an outer housing 21' and an inner housing or closure cap 41'. The closure cap has a screw thread formed internally thereon (not shown) adapted to threadably engage thread 13' to secure the closure cap on the container. An indicia disc 62', conforming to the dimensions of closure cap 41' may be removably mounted therein.

The indicia disc may be secured to closure cap 41' by a standard adhesive or by aligning and engaging a recess 64', formed in the disc, with a projection 65 extending upwardly from the closure cap. Such alignment will secure the indicia disc against rotation relative to the closure cap. As described in U.S. Pat. No. 4,365,722 (e.g., FIG. 12), the indicia disc could be eliminated and the indicia imprinted or otherwise secured directly on closure cap 41', as shown in FIG. 5. Further, additional indicia can be circumferentially disposed on selected outer surface portions (e.g., sidewall) of the closure cap. Additional display windows 23' would be suitably formed through outer housing 21' to visually display such additional indicia to a user.

As further shown in FIG. 5, a radially outwardly projecting annular ridge 43' is formed around the lower end of closure cap 41'. Outer housing 21' is rotatably mounted for indexing movement on the closure cap. The outer housing and closure cap are secured together against relative vertical movement by an annular retaining groove 39', formed around the lower end of the outer housing to receive ridge 43' of the closure cap therein.

As described in U.S. Pat. No. 4,365,722, indexing means are provided so that when closure assembly 11' is rotated clockwise to its fully tightened condition on container 12', outer housing 21' can be further and selectively rotated relative to closure cap 41'. This further rotation will provide the desired step-by-step indexing function to sequentially expose individual indicia 68', imprinted on indicia disc 62', through display window 23'. The indexing function is controlled by a ratchet mechanism or one-way clutch arrangement comprising interengaging wedge-shaped abutment members or ribs 25' and generally triangularly-shaped grooves 42'.

As shown in FIG. 4, clockwise rotation of outer housing 21' (with the closure assembly fully tightened on the container) will move each rib 25' of the diametrically opposed pair of ribs circumferentially into its next adjacent groove 42' to expose the next-following indicia 68' through window 23'. The plastic material composing the outer housing, including ribs 25', is sufficiently resilient and compressible to facilitate this racheting action. Conversely, outer housing 21' is unable to rotate counterclockwise relative to closure cap 41' due to the illustrated "one-way" constructions of ribs 25' and grooves 42'.

Indicia 68' are circumferentially disposed on indicia disc 62' (or the indicia imprinted directly on the closure cap) to match the circumferential spacing of grooves 42'. Thus, one of the indicia will be visible through display window 23', formed in the upper wall of outer housing 21', at each step in the racheting process.

Above-described container 12' and closure assembly 11' have been modified to incorporate the snap-lock feature of this invention therein. In particular, a lock tab 17', similar to lock tab 17, is formed integrally with closure cap 41'. When the closure cap is fully tightened-down onto container 12', the lock tab will flex inwardly into a locking slot 16' to releasably secure the closure cap and container against relative rotation. The locking slot is formed in an annular flange 15', formed externally on the neck of the container.

Figure 9:
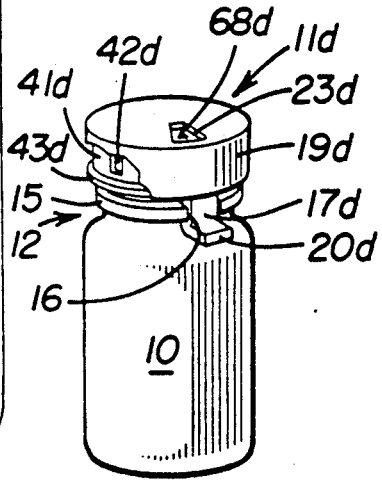
FIG. 9 is a frontal isometric view showing the addition of the adjustable reminder feature to the FIG. 1 screw cap container embodiment.
Figure 6:
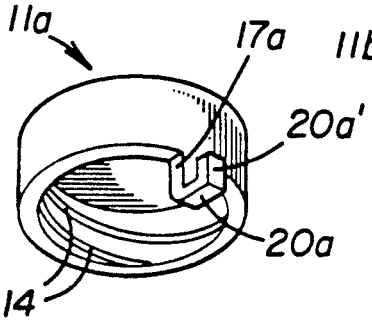
FIGS. 6–8 are isometric views illustrating alternative closure caps and lock tabs for the FIGS. 1 and 3 containers.
Figure 7:
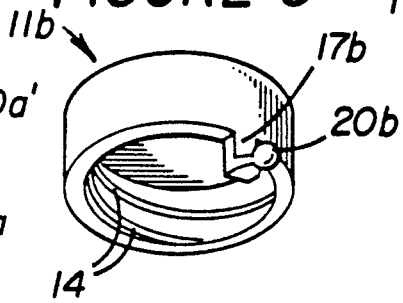
Figure 8:
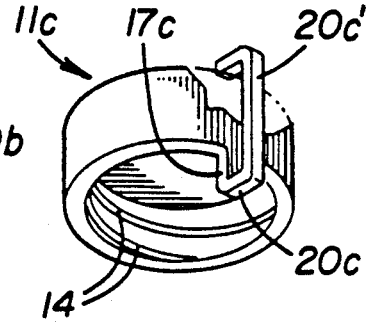

FIGS. 6-8 illustrate alternative lock tab embodiments for use with closure cap 11 (FIG. 1) 41' (FIG. 5) or **41*d* (FIG. 9). As shown in FIG. 6, a lock tab 17*a* is integrally secured to a closure cap 11*a* and has a thumb tab 20*a* extending radially outwardly from its distal end. A generally vertically disposed outer tab 20*a'* is secured to a distal end of thumb tab 20*a* to form an inverted U-shaped hook extending outwardly from the cap. The hook facilitates a pulling-out and release of the lock tab from locking slot 16** for closure cap removal purposes.

In FIG. 7, a knob **20*b* is secured to a lock tab 17*b*, formed integrally with a closure cap 11*b***. The knob extends radially outwardly from the lock tab and container to facilitate release of the lock tab for container opening purposes.

FIG. 8 illustrates a lock tab **17*c*, formed integrally on a closure cap 11*c*, having a thumb tab 20*c* and a lever arm 20*c'* secured to a distal end of the thumb tab. The lever arm is spaced radially outwardly from the lock tab and container and extends upwardly to terminate adjacent to a top of (partially sectioned) closure cap 11*c***.

FIG. 9 illustrates the addition of the reminder feature to a closure assembly **11*d*, similar in configuration to closure cap 11 (FIG. 1). The reminder structure is similar to that described in U.S. Pat. No. 4,365,722 and may be of general type described above, including indexing means controlled by a ratchet mechanism. The ratchet mechanism may also include circumferentially spaced grooves 42***d* formed on a closure cap 41*d* and ribs (not shown) formed internally on an outer housing 19*d* which function similar to ribs 25' and grooves 42' (FIG. 4).

Circumferentially disposed indicia 68*d* may be formed on a separate disc secured to closure cap 41*d* or may be imprinted directly on the cap. A window 23*d* is formed through outer housing 19*d* to expose indicia 68*d* in the manner described above. An annular ridge 43*d*, formed externally on the lower end of closure cap 41*d*, snaps into locked relationship within a mating groove formed internally on outer housing 19*d* to permit relative rotational movement therebetween but to prevent relative vertical displacement. A lock tab 17*d*, having a thumb tab 20*d*, is integrally formed on closure cap 41*d* and is similar in structure and function to lock tab 17' (FIGS. 3 and 5).

From the above description, it will be appreciated that engagement of the lock tab with the locking slot in the described embodiments of this invention will afford child resistance to the closure cap container combination. The user can only unscrew the closure cap from the container by applying upward and outward pressure on the lock tab to flex and disengage it from the locking slot. The simultaneous application of this upward and outward pressure on the lock tab, along with the required unscrewing torque on the closure cap, is beyond the capacity of a child, but is "adult friendly."

The combination of this form of child-resistance with the reminder feature described above (FIGS. 3-5 and 9) allows the closure cap to be made from only two pieces (exclusive of the indicia disc, if used). Further, only a slight modification need be made to a standard threaded bottle i.e., the provision of the locking slot in the bottle's decorative flange. The resultant system is less complex and requires less material than the three-piece version.

I claim:

1. A screw-cap container comprising a container having a neck terminating at a dispensing opening, first screw thread means and an annular flange formed externally and extending circumferentially on said neck, said flange being positioned vertically below and having an annular outer surface disposed radially outwardly from an outer surface of said first screw thread means and being discontinuous to define a locking slot between opposite ends thereof, a closure cap having second screw thread means formed internally thereon for engaging said first screw thread means in threaded engagement therewith whereby said closure cap can be rotated to a fully tightened condition on said container when said first and second screw thread means are fully engage, and lock tab means, having an inner surface disposed radially between the outer surface of said flange and outer surface of said first screw thread means, secured to said closure cap for flexing radially outwardly when its inner surface engages the outer surface of said flange in response to a screwing-down of said closure cap on said container and for automatically flexing radially inwardly into engagement within said locking slot when said closure cap is in its fully tightened condition on said container to prevent relative rotation between said container and said closure cap and exhibiting sufficient flexibility to permit said lock tab means to be moved radially outwardly from its engagement within said locking slot for permitting said closure cap to be unscrewed and removed from said container, said lock tab means comprising a vertically disposed lock tab extending downwardly from said closure in close proximity to the neck of said container and wherein said closure cap further comprises a vertically disposed cylindrical outer wall having a predetermined thickness and wherein said lock tab is formed integrally with said outer wall and has a thickness at least substantially the same as the thickness of said outer wall and is vertically aligned therewith.

2. The screw-cap container of claim 1 wherein said closure cap and said lock tab means are molded together and are at least essentially formed from the same plastic material.

3. The screw-cap container of claim 1 further comprising adjustable reminder means for visually displaying information to a user relating to periodic use of contents of said container.

4. The screw-cap container of claim 3 wherein said adjustable reminder means comprises an outer housing mounted on said closure cap, indicia means disposed between said outer housing and said closure cap for sequentially visually displaying said information in response to relative rotation between said outer housing and said closure cap, and indexing means for only permitting said relative rotation in one direction when said closure cap is in its fully tightened condition on said container.

5. The screw-cap container of claim 4 wherein said indicia means comprises indicia circumferentially spaced on said closure cap.

6. The screw-cap container of claim 4 wherein said indicia means comprises indicia on a disc positioned on said closure cap.

7. The screw-cap container of claim 1 wherein a thumb tab extends radially outwardly from a distal end of said lock tab.

8. The screw-cap container of claim 7 wherein a generally vertically disposed outer tab is secured on a distal end of said thumb tab to form a generally inverted U-shaped hook with said lock tab and said thumb tab.

9. The screw-cap container of claim 7 wherein a lever arm is secured to a distal end of said thumb tab and is spaced radially outwardly from said lock tab and from said container, said lever arm extending upwardly to terminate adjacent to a top of said closure cap.

10. The screw-cap container of claim 1 wherein a knob is secured to said lock tab to extend radially outwardly therefrom and from said container.

* * * * *